US008109050B2

(12) United States Patent
Ovaert

(10) Patent No.: US 8,109,050 B2
(45) Date of Patent: Feb. 7, 2012

(54) FLOORING APPARATUS FOR REDUCING IMPACT ENERGY DURING A FALL

(75) Inventor: Timothy C. Ovaert, Granger, IN (US)

(73) Assignee: University of Notre Dame Du Lac, Notre Dame, IN (US)

( * ) Notice: Subject to any disclaimer, the term of this patent is extended or adjusted under 35 U.S.C. 154(b) by 804 days.

(21) Appl. No.: 11/673,398

(22) Filed: Feb. 9, 2007

(65) Prior Publication Data

US 2007/0204545 A1 Sep. 6, 2007

Related U.S. Application Data

(60) Provisional application No. 60/771,630, filed on Feb. 9, 2006, provisional application No. 60/793,457, filed on Apr. 20, 2006.

(51) Int. Cl.
*E04F 15/22* (2006.01)

(52) U.S. Cl. ..... 52/181; 52/177; 52/1; 52/403.1

(58) Field of Classification Search ..... 52/403.1, 52/177, 181, 263, 1

See application file for complete search history.

(56) References Cited

U.S. PATENT DOCUMENTS

| | | | | |
|---|---|---|---|---|
| 1,693,655 | A * | 12/1928 | Murphy | 52/402 |
| 2,653,525 | A | 9/1953 | McGuire | |
| 3,251,076 | A * | 5/1966 | Burke | 428/116 |
| 3,305,227 | A * | 2/1967 | Henley | 267/153 |
| 3,438,312 | A * | 4/1969 | Becker et al. | 404/40 |
| 3,636,577 | A | 1/1972 | Nissen | |
| 3,808,628 | A | 5/1974 | Betts | |
| 3,948,500 | A | 4/1976 | Korbuly et al. | |
| 4,054,987 | A * | 10/1977 | Forlenza | 29/452 |
| 4,277,055 | A | 7/1981 | Yamaguchi et al. | |
| 4,557,475 | A | 12/1985 | Donovan | |
| 4,604,509 | A | 8/1986 | Clancy et al. | |
| 4,727,697 | A * | 3/1988 | Vaux | 52/177 |
| 4,805,886 | A | 2/1989 | Hassan | |
| 4,807,412 | A | 2/1989 | Frederiksen | |
| 4,846,457 | A | 7/1989 | Vaux | |
| 4,848,058 | A | 7/1989 | Mullen | |
| 4,860,516 | A * | 8/1989 | Koller et al. | 52/480 |

(Continued)

FOREIGN PATENT DOCUMENTS

JP 1980000034720 10/1981

(Continued)

OTHER PUBLICATIONS

International Search Report Corresponding to International Application No. PCT/US07/61933, Mailed Jun. 5, 2008, 4 pages.

(Continued)

*Primary Examiner* — Khoi Tran
*Assistant Examiner* — Jason Holloway
(74) *Attorney, Agent, or Firm* — Greenberg Traurig, LLP

(57) ABSTRACT

A floor including a flooring plate and a plurality of spaced apart stiffening columns extending from an underside of the flooring plate. The columns remain substantially rigid up to a predetermined critical pressure and then buckle as the pressure increases. The columns are at least partially surrounded by a resilient underlayment. Deflection stops may extend from the flooring plate to prevent over-buckling and/or permanent deformation of the stiffening columns. In some examples, the deflections stops may assist the floor in providing a substantially rigid surface at very high pressures.

28 Claims, 4 Drawing Sheets

U.S. PATENT DOCUMENTS

| | | | | | |
|---|---|---|---|---|---|
| 4,921,741 | A | | 5/1990 | Mullen | |
| 4,948,116 | A | | 8/1990 | Vaux | |
| 4,991,834 | A | * | 2/1991 | Vaux | 472/92 |
| 4,998,717 | A | | 3/1991 | Vaux | |
| 5,228,253 | A | * | 7/1993 | Wattelez | 52/177 |
| 5,234,738 | A | * | 8/1993 | Wolf | 428/120 |
| 5,251,742 | A | | 10/1993 | Campbell | |
| 5,368,154 | A | | 11/1994 | Campbell | |
| 5,509,244 | A | | 4/1996 | Bentzon | |
| 5,542,221 | A | * | 8/1996 | Streit et al. | 52/403.1 |
| 5,566,930 | A | | 10/1996 | Niese | |
| 5,713,175 | A | * | 2/1998 | Mitchell | 52/582.1 |
| 5,744,763 | A | | 4/1998 | Iwasa et al. | |
| 5,749,111 | A | | 5/1998 | Pearce | |
| 5,761,867 | A | * | 6/1998 | Carling | 52/386 |
| 5,778,621 | A | * | 7/1998 | Randjelovic | 52/403.1 |
| 5,806,270 | A | * | 9/1998 | Solano et al. | 52/747.11 |
| 5,976,451 | A | | 11/1999 | Skaja et al. | |
| 5,992,105 | A | | 11/1999 | Kessler et al. | |
| 6,026,527 | A | | 2/2000 | Pearce | |
| 6,029,962 | A | | 2/2000 | Shorten et al. | |
| 6,044,606 | A | | 4/2000 | Hamar | |
| 6,115,981 | A | * | 9/2000 | Counihan | 52/403.1 |
| 6,127,015 | A | | 10/2000 | Kessler | |
| 6,164,031 | A | * | 12/2000 | Counihan | 52/480 |
| 6,296,669 | B1 | | 10/2001 | Thorn et al. | |
| 6,394,432 | B1 | | 5/2002 | Whiteford | |
| 6,405,495 | B1 | | 6/2002 | Kessler et al. | |
| 6,457,261 | B1 | | 10/2002 | Crary | |
| 6,487,796 | B1 | | 12/2002 | Avar et al. | |
| 6,531,203 | B2 | * | 3/2003 | Kessler et al. | 428/137 |
| 6,878,430 | B2 | * | 4/2005 | Milewski et al. | 428/131 |
| 7,211,314 | B2 | * | 5/2007 | Nevison | 428/143 |
| 7,462,253 | B2 | * | 12/2008 | Nevison | 156/64 |
| 7,571,572 | B2 | * | 8/2009 | Moller, Jr. | 52/177 |
| 7,575,795 | B2 | * | 8/2009 | Scott et al. | 428/120 |
| 7,748,177 | B2 | * | 7/2010 | Jenkins et al. | 52/177 |
| 2001/0007236 | A1 | | 7/2001 | Tajima et al. | |
| 2003/0186025 | A1 | * | 10/2003 | Scott et al. | 428/119 |
| 2005/0193669 | A1 | * | 9/2005 | Jenkins et al. | 52/392 |
| 2005/0214498 | A1 | * | 9/2005 | Nevison | 428/44 |
| 2007/0056237 | A1 | * | 3/2007 | Kang et al. | 52/403.1 |

FOREIGN PATENT DOCUMENTS

| | | |
|---|---|---|
| JP | 1980000034721 | 10/1981 |

OTHER PUBLICATIONS

Written Opinion of the International Searching Authority Corresponding to International Application No. PCT/US0761933, Mailed Jun. 5, 2008, 7 pages.

"Accident Facts," National Safety Council, 1990 Edition, 9 pages, Chicago.

Philips et al., "Aging and Public Health," 1985, 23 pages, Springer Publishing Company, Inc., New York.

Devitto et al., "Fall Injuries Among the Elderly," Journal of the American Geriatrics Society, vol. 36, 1988, 8 pages.

Tideiksaar, Rein, "Falls in the Elderly: A Literature Review," Age, vol. 11, Issue 3, Jul. 1988, 4 pages.

Grisso et al., "Injuries in an Elderly Inner-City Population," The American Geriatrics Society, 1990, 7 pages.

"Healthy People 2000," National Health Promotion and Disease Prevention Objectives, U.S. Department of Health adn Human Services Public Health Service, 1992, 6 pages, Jones and Bartlett Publishers, Inc., Boston.

"Injury Prevention: Meeting the Challenge," The National Committee for Injury Prevention and Control, American Journal of Preventive Medicine, vol. 5, No. 3, 1989, 4 pages.

Older Americans 2004: Key Indicators of Well-Being, Federal Interagency Forum on Aging-Related Statistics, Nov. 2004, 160 pages, U.S. Government Printing Office, Washington, D.C.

Sattin et al., "The Incidence of Fall Injury Events Among the Elderly in a Defined Population," American Journal of Epidemiology, vol. 131, No. 6, 1990, 5 pages, The John Hopkins University School of Hygiene and Public Health.

Sorock, Gary S., "Falls Among the Elderly: epidemiology and prevention," American Journal of Preventive Medicine, vol. 4, No. 5, 1988, 8 pages.

United States Population Estimates, by Age, Sex, and Race: 1980-1987, U.S. Department of Commerce, Mar. 1988, 13 pages.

Waller, Jillian A., "Falls Among the Elderly—Human and Environmental Factors," Accident Analysis and Prevention, vol. 10, 1978, 13 pages.

International Search Report corresponding to International Patent Application No. PCT/US07/61933, mailed Jun. 5, 2008, 2 pages.

Written Opinion of the International Searching Authority corresponding to International Patent Application No. PCT/US07/61933, mailed Jun. 5, 2008, 5 pages.

* cited by examiner

FLOORING APPARATUS FOR REDUCING IMPACT ENERGY DURING A FALL

CROSS REFERENCE TO RELATED APPLICATION

This application is a non-provisional application claiming priority from U.S. Provisional Application Ser. No. 60/771,630, filed Feb. 9, 2006, entitled "SorbaShock Pressure Reduction Flooring" and from U.S. Provisional Application Ser. No. 60/793,457, filed Apr. 20, 2006, each of which is incorporated herein by reference in their entirety.

FIELD OF THE DISCLOSURE

The present disclosure relates generally to cushioned flooring systems, and in particular to a flooring apparatus for reducing impact energy during a fall.

BACKGROUND OF RELATED ART

It is known that falls represent a leading cause of non-fatal injuries in the United States (Cost of Injury, 1989). In 1985, for example, falls accounted for an estimated 21% of non-hospitalized injured persons (11.5 million people) and 33% of hospitalized injured persons (783,000 hospitalizations). In addition 9% of fatalities (12,866 deaths) were related to falls. Some estimates have said that the cost of fall related injuries in the United States in 2000 was approximately $20 billion dollars.

A number of epidemiological studies report a drastic increase of fall incidence rate in the population over the age of 65, suggesting a direct relationship between aging and the frequency of fall events (Sorock, 1988; Healthy People 2000, 1990; Injury Prevention: Meeting the Challenge, 1989; National Safety Council, 1990; Grisso et al., 1990; DeVito et al., 1988; Waller, 1985; Waller, 1978; Sattin et at., 1990). Although the exact incidence of non-fatal falls is difficult to determine, it has been estimated that approximately 30% of all individuals over the age of 65 have at least one fall per year (Sorock, 1988).

When the dramatic growth in the number of people over 65 and their proportion in the population is considered, this represents a significant health problem. By some estimates, this age group currently makes up 12.4% of the U.S. population, with a projected increase to 19.6% by the year 2030 (Federal Interagency Forum on Aging-Related Statistics, 2004). Of particular note is the growth of the "oldest old" (i.e. those people over 75). In the decade between 1990 and 2000, the greatest growth in the over 55 age group was projected to be among those 75 and older—an increase of 26.2 percent or a gain of nearly 4.5 million (U.S. Dept. of Commerce, Bureau of Census, 1988).

In Injury in America (1985, p. 43) the authors stated that "Almost no current research deals with the mechanisms and prevention of injury from falls (the leading cause of non-fatal injury) . . . Little is known about the effectiveness of energy-absorbing materials, either worn by persons at high risk or incorporated in the surfaces onto which they fall."

Typically, current approaches to solving the problem of injury from falls include devices which use composite matting to absorb energy resulting from patient/floor impact during falls. For example, U.S. Pat. Nos. 3,636,577, 4,557,475, 4,727,697, 4,846,457, 4,948,116, 4,991,834 and 4,998,717, each describe impact absorbing coverings which utilize air-filled cells or compressible materials to absorb the energy of a fall. Because each of these systems is always compliant (i.e., always deformable under compressive pressures), shoes, feet, and/or other contacts with the flooring surface results in relatively large mat deflections. This has the potential to increase the likelihood of falls due to toe/mat interference during foot wing, and/or presents a problem when an individual attempts to move an object over the floor (e.g., a wheelchair). These factors can be of even greater concern in a health care setting, where many residents may have an unsteady gait and/or utilize wheel chairs for locomotion.

The disclosed floor overcomes at least some of the above-described disadvantages inherent with various apparatuses and methods of the prior art. The example floor includes a flooring system which requires no special clothing or restriction of movement because the floor will act as the injury prevention system. The design incorporates a stiffened floor which remains substantially rigid under normal conditions and deflects under impact (i.e., a pressure greater than a predetermined critical pressure) to absorb the energy of the impact. Accordingly, the examples floor offers a novel and effective system to reduce injuries from falls.

DETAILED DESCRIPTION

An impact-absorbing flooring system is described, with applications in various areas where there is a risk of injury due to fall and/or high-impact. For instance, the flooring system may be utilized in healthcare facilities, in sports facilities, and/or in any other commercial or residential environment. The floor may be manufactured as a single continuous floor, or may be manufactured as a modular tile that may be combined with adjoining tiles to form a floor surface. The flooring system may also take the form of a safety mat or coating for use around slippery areas, such as, for example, bathtubs, showers, swimming pools, etc.

Figure 1:
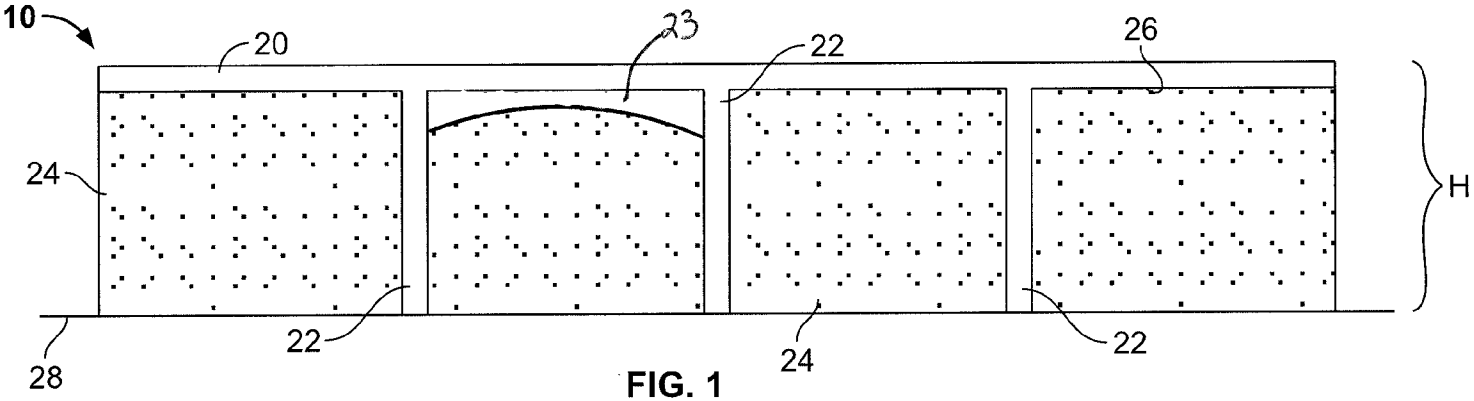
FIG. 1 is a side elevational view of an example flooring apparatus for reducing impact during a fall.
Figure 2:
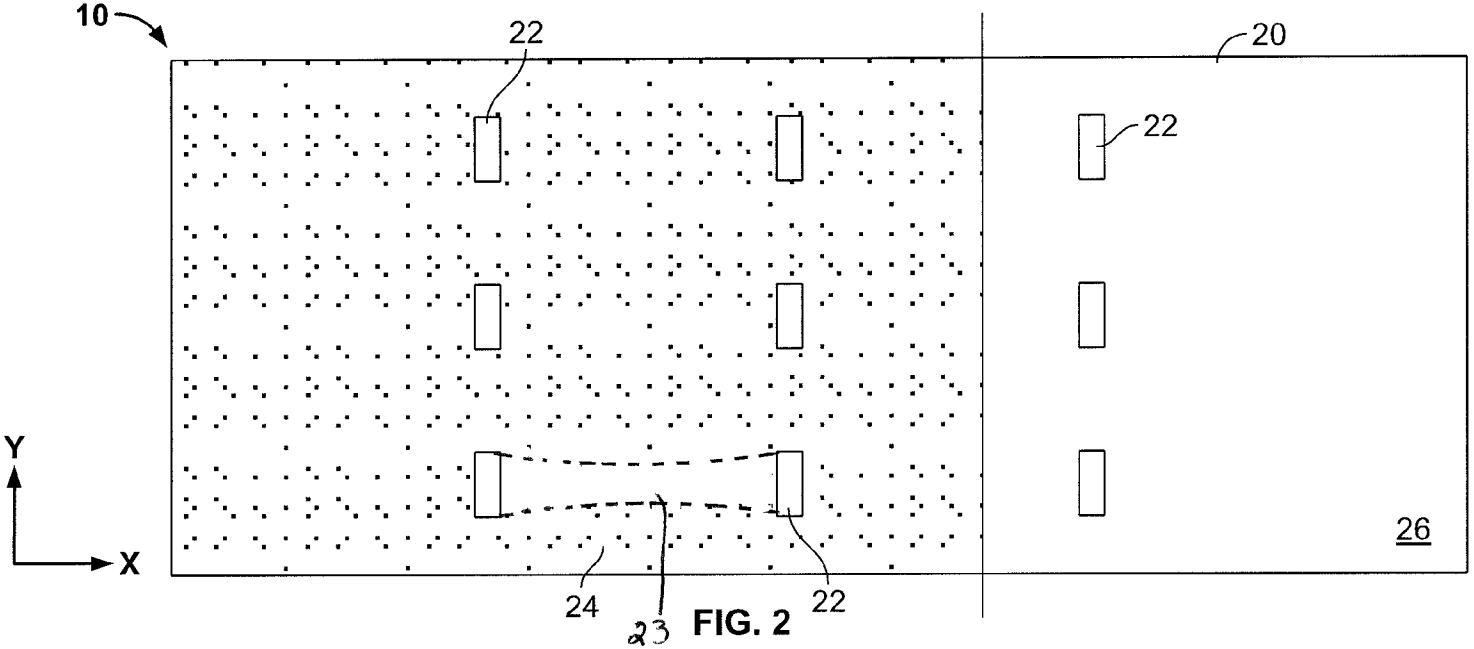
FIG. 2 is a bottom side view of the flooring apparatus of FIG. 1 with a portion of the underlayment removed.

FIGS. 1 and 2 together illustrate an example flooring apparatus 10. The apparatus 10 may provide a significant reduction in peak impact pressure during falls, yet retains a substantially non-compliant configuration during normal pressures. In particular, in the illustrated example, the apparatus 10 includes a flooring plate 20 having a plurality of spaced apart stiffening columns 22, extending from an undersurface 26 of the flooring plate 20. Each of the columns 22 may be integrally formed with the plate 20, or may be coupled to the plate 20 as desired. In the illustrated example, the stiffening columns 22 are generally rectangular and extend generally perpendicular to the plate 20. In this example, the columns are spaced at generally 90° to one another. It will be appreciated, however, that the angle from which the columns 22 extend from the plate 20, as well as the pattern of the columns 22 may be varied as desired. Furthermore, while the columns 22 are illustrated as separate bodies, the columns could be coupled via bridge-like connections, or otherwise connected together to form a straight and/or curvilinear rib 23 (see, for example, FIGS. 1, 2).

The stiffening columns 22 are at least partially (and possible completely) surrounded by a resilient underlayment 24. The underlayment 24 may cover at least a portion of the undersurface 26 of the flooring plate 20 and may be secured thereto. Additionally, the underlayment may be secured to at least one of the columns 22. The columns 22 and/or the underlayment 24 (together or separately) are adapted to support the flooring plate 20 at a normal H above a support surface 28, such as for example, a sub-floor.

The flooring plate 20 may be constructed of any suitable material including, for example, wood, metal, thermoplastic, such as polyester, polypropylene, and/or polyethylene, and/or any other suitable material. Similarly, the plate 20 may be formed by any suitable manufacturing process, including, for instance, molding, stamping, rolling, etc. Additionally, while in this example the stiffening columns 22 are integrally formed with the plate 20, it will be appreciated by one of ordinary skill in the art that the columns 22 may be constructed of any appropriate material and as noted above, may be attached to the undersurface 26 via any suitable method, such as, for example, adhesive, mechanical, and/or other comparable fasteners.

In the illustrated example, the resilient underlayment 24 is a foam material, such as, for example, a polymer foam. However, it will be appreciated by one of ordinarily skill in the art that the resilient underlayment 24 may be formed from any suitably resilient material, and/or composite material. Furthermore, resilient underlayment 24 may also be secured to the undersurface 26 of the flooring plate 20 and/or the columns 22 by adhesion, mechanical connection, and/or any other appropriate method.

Figure 3:
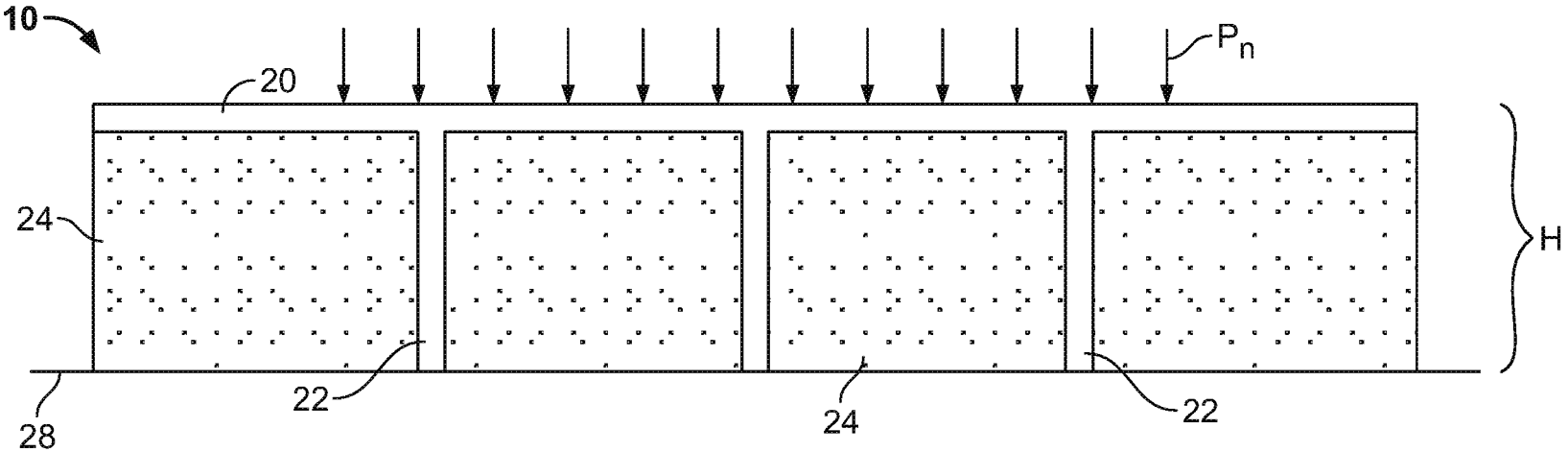
FIG. 3 is a side elevational view of the example flooring apparatus of FIG. 1 showing the floor being subjected to a compressive pressure under normal conditions.
Figure 4:
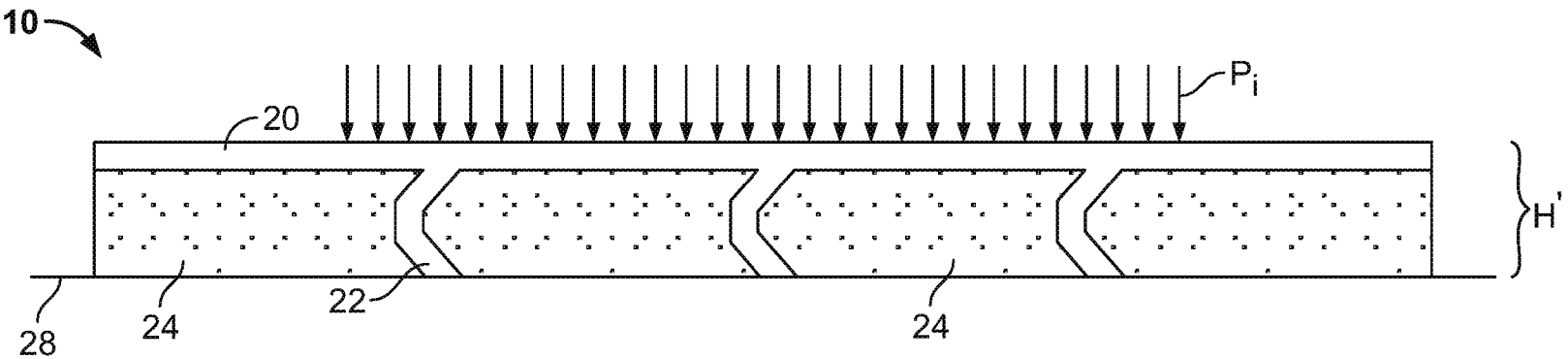
FIG. 4 is a side elevational view of the example flooring apparatus of FIG. 1 showing the floor being subjected to a compressive pressure under impact conditions.

Turning now to FIGS. 3 and 4, the flooring apparatus 10 is illustrated under the influence of two different compressive pressures. In FIG. 3, the flooring apparatus 10 is subjected to a compressive pressure $P_n$ distributed over the plate 20 under normal conditions, wherein the pressure $P_n$ is under a predetermined critical pressure (i.e., the pressure at which the column 22 will buckle). For example, the pressure $P_n$ may be the distributed pressure of an individual (or object) walking, standing, running, or otherwise moving over the plate 20. Under these conditions, the plate 20 of the apparatus 10 will not deflect in any appreciable manner, but rather the stiffening columns 22 will remain substantially rigid and will support the plate 20 at the normal height H above the support surface 28.

In FIG. 4, the flooring apparatus 10 is subjected to a compressive pressure $P_i$ distributed over the plate 20 under impact conditions, wherein the pressure $P_i$ is over the predetermined critical pressure (i.e., the pressure at which the column 22 will buckle). For example, the pressure $P_i$ may be the distributed pressure of an individual falling on or otherwise impacting the plate 20. Additionally, while described as an impact pressure, the pressure $P_i$ need not result from impact, but rather may be any pressure, such as, for example, a static pressure. Under these conditions, a portion of the plate 20 of the apparatus 10 will deflect toward the support surface 28 (such as for example to a height H') and the stiffening columns 22 will buckle and deflect to absorb the energy of the impact. The columns 22 may, therefore, be the primary means of energy absorption, while the resilient nature of the underlayment 24 may provide a secondary means of energy absorption as the apparatus 10 deforms. After the impact pressure is removed, or otherwise dissipated, the apparatus 10 will substantially return to its original state and the plate 20 will once again be supported at the typical height H above the support surface 28 (FIG. 1).

Referring again to FIG. 2, the apparatus 10 of FIG. 1 is illustrated in a bottom side view, with a portion of the underlayment 24 removed to expose the plate 20. As illustrated, the columns 22 in this example have a generally rectangular cross-section, but it will be understood that the cross section may vary as desired. For example, because the stiffness of each of the columns 22 is directly proportional to the area moment of inertia of that column, in this example the stiffness of each column is generally greater in the y-direction than in the x-direction. Similarly, the because the columns 22 are at least partially encapsulated in the underlayment 24, the properties of the underlayment 24, the properties of the underlayment 24 aid in the control of the buckling pressure and the post-buckling deformation of the columns 22.

The critical pressure (e.g., the magnitude of the compressive pressure at which the column 22 will buckle) is determined by a number of factors, including, for example, the column 22 will buckle) is determined by a number of factors, including, for example, the column length, width, area moment of inertia, material properties, the boundary conditions imposed at the column end points, the distribution of the columns on the plate 20, the angle at which the columns extend from the plate 20, and/or the properties of the underlayment 24. In one example, a desired predetermined critical pressure may be approximately 20 $lbs/in^2$. Because the critical pressure at which buckling of each of the columns 22 will occur is determined by many factors, it is possible to vary the design of the columns 22 and/or the underlayment 24 for a specifically desired critical pressure by varying some or all of these parameters utilizing known analysis methods such as Euler calculations and/or finite element analysis. Therefore it is possible to configure the columns 22 and/or the underlayment 24 so that the flooring apparatus 10 will remain relatively rigid under normal pressure but will buckle under impact pressures typically sustained during a fall. Varying the parameters of the columns 22 and/or the underlayment will permit construction of multiple embodiments having various uses from private dwellings, bathrooms, and geriatric homes to hospital and athletic events where impact pressures are expectedly variable.

Figure 5:
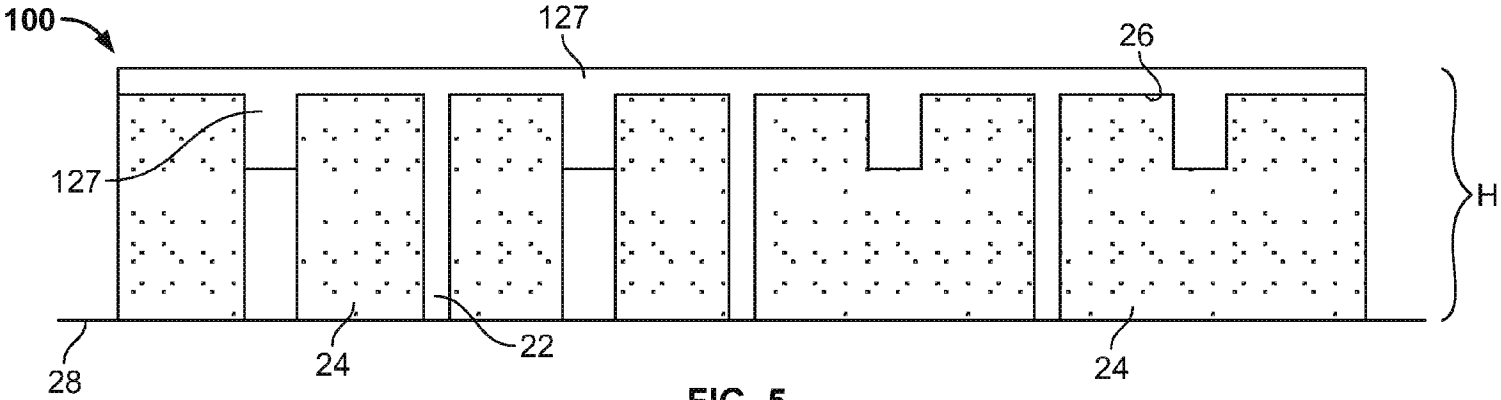
FIG. 5 is a side elevational view of another example flooring apparatus for reducing impact during a fall.
Figure 6:
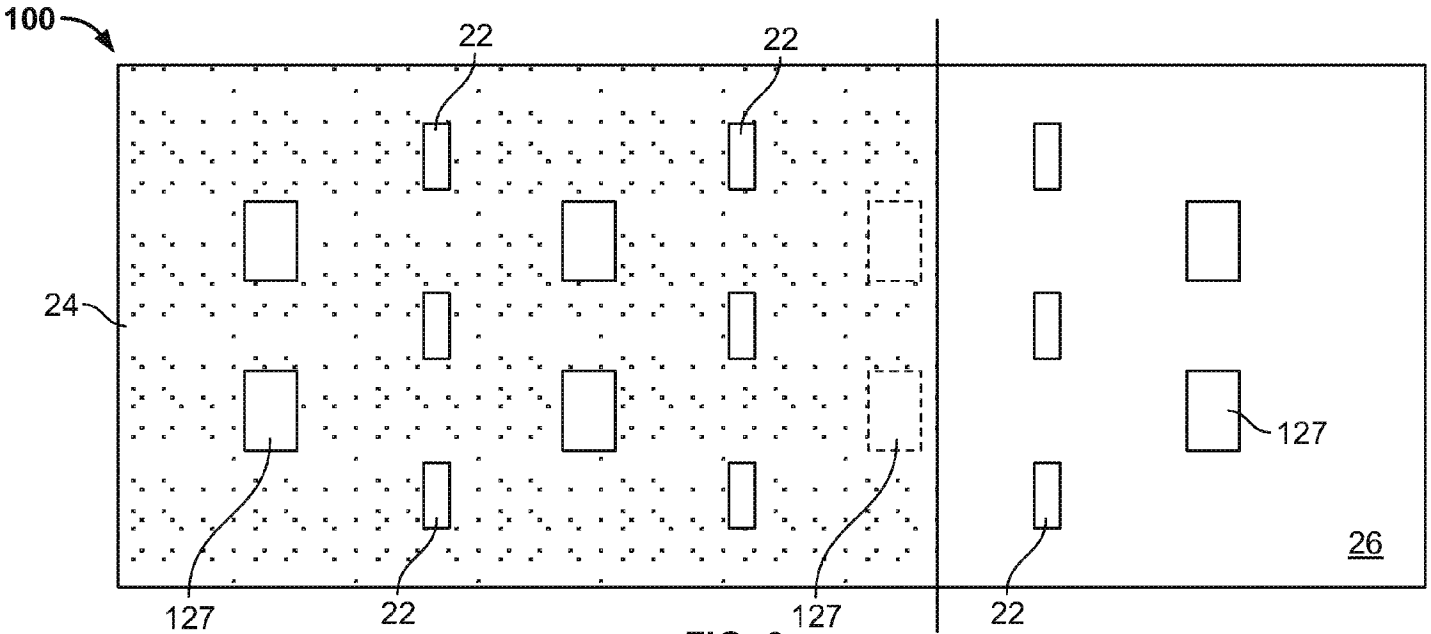
FIG. 6 is a bottom side view of the flooring apparatus of FIG. 5 with a portion of the underlayment removed.

FIGS. 5 and 6 illustrate another example of a flooring apparatus 100 similar to the flooring apparatus 10 of FIG. 1, but including a stop to prevent over-deformation. In particular, the apparatus 100 includes the flooring plate 20 having the plurality of spaced apart stiffening columns 22, extending from the undersurface 26 of the flooring plate 20 as described above. The apparatus 100, however, further includes a plurality of spaced apart deflection stops, such as stop columns 127, additionally extending from the undersurface 26 of the flooring plate 20. In this example, the stop columns 127 extend a shorter distance from the undersurface 26 of the plate 20 than the stiffening columns 22. As with the stiffening columns 22, each of the stop columns 127 may be integrally formed with the plate 20, or may be coupled to the plate 20 as desired.

In the illustrated example, both the stiffening columns 22 and the stop columns 127 extend generally perpendicular to the plate 20 and are, in this example, spaced at generally 45° to one another. However, it will be appreciated that the pattern of the columns 22 and 127 may be varied as desired. Furthermore, while the length of each of the stiffening columns 22 and the length of each of the stop columns 127 are illustrated as being substantially similar, respectively, it will be understood that the length of each of the columns 22, 127 may vary as desired to provide for different pressure deflection characteristics.

As with the previous example, both the stiffening columns 22 and the stop columns 127 are at least partially surrounded by the resilient underlayment 24. Additionally, the underlayment 24 may be secured to at least a portion of the undersurface 26 of the flooring plate 20 and/or at least a portion of the columns 22, 127. As shown is FIG. 5, the resilient underlayment 24 may completely cover any of the columns 127 or may at least partially expose any of the columns 127 when viewed from the underside 26.

Figure 7:
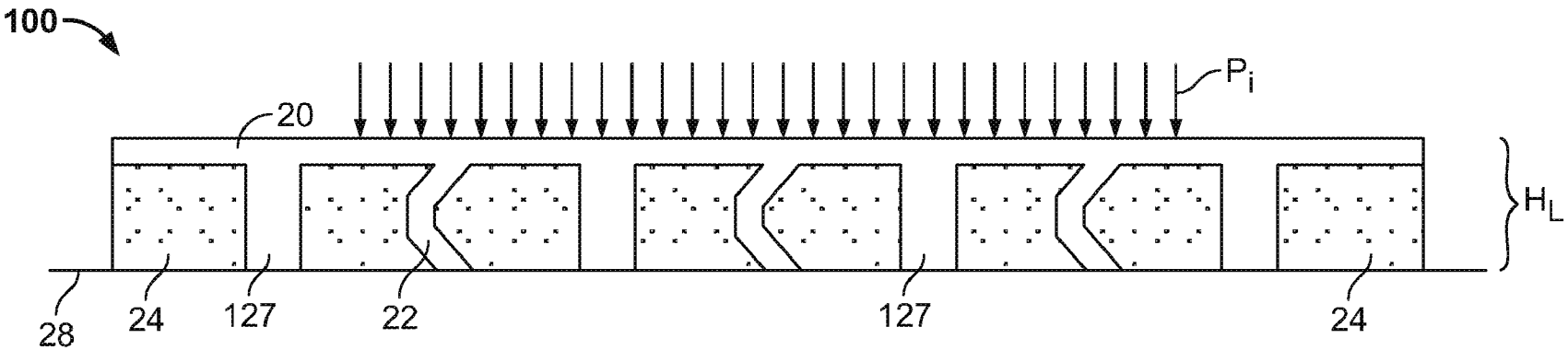
FIG. 7 is a side elevational view of the example flooring apparatus of FIG. 5 showing the floor being subjected to a compressive pressure under impact conditions.

FIG. 7 illustrates the example flooring apparatus 100 under the influence of a compressive pressure $P_i$ distributed over the plate 20 under impact conditions. As with the previous example, in this example, the pressure $P_i$ is greater than the predetermined critical pressure (e.g., the pressure at which the columns 22 will buckle). Under these conditions, the plate 20 of the apparatus 100 will deflect toward the support surface 28 and the stiffening columns 22 will deflect to absorb the energy of the impact. The amount of deflection in the plate 20, however, is limited at a height $H_L$ by contact of the deflection stops columns 127 with the support surface 28. The columns 22 may, therefore, be the primary means of energy absorption, while the resilient nature of the underlayment 24 provides a secondary means of energy absorption as the floor deforms. The stopping columns 127, meanwhile, may provide a deflection stop to prevent over-buckling and/or permanent deformation of the columns 22 as well as provide the ability for the flooring apparatus 10 to resume a substantially rigid state after initial deflection to assist, for example, individuals utilizing wheelchairs. After the impact pressure is removed, or otherwise dissipated, the apparatus 10 will return substantially to its original state and the plate 20 will once again be supported at the typical height H above the support surface 28 (FIG. 5).

Figure 8:
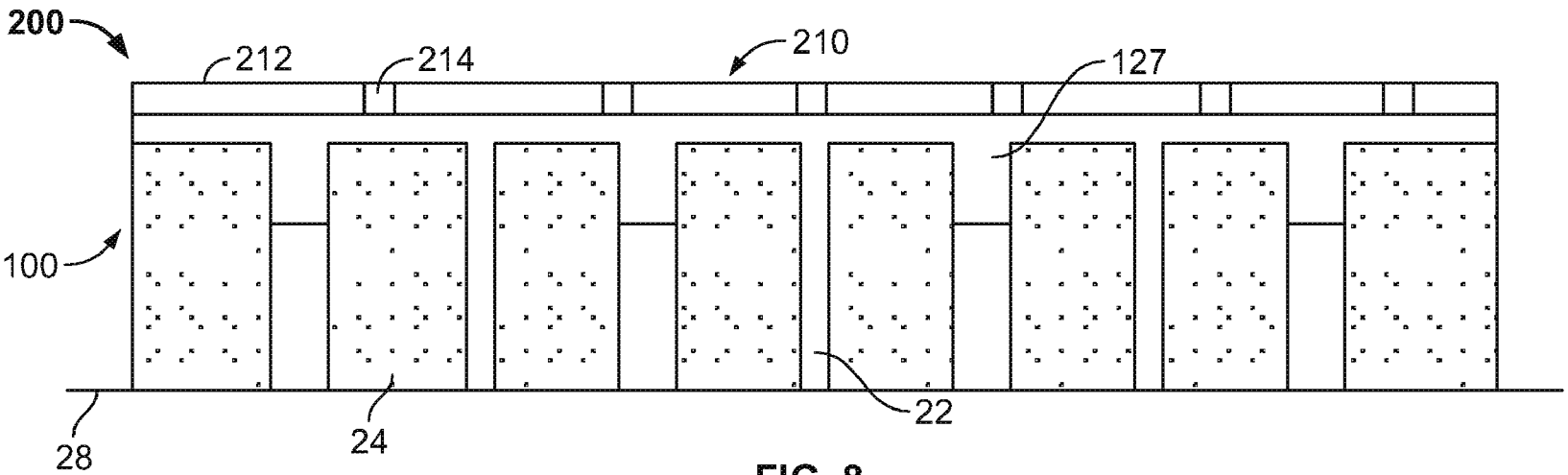
FIG. 8 is a side elevational view of the flooring apparatus of FIG. 5 including a tile overpayment.

Turning now to FIG. 8, an example of an enhanced flooring system 200 is shown. The system 200 includes one of the flooring apparatus 100 and/or 10 (the flooring apparatus 100 is illustrated) including an overlayment 210. In this example, the overlayment 210 comprises a plurality of tiles 212, such as traditional floor tiles, and a flexible grout 214, such as for example, a sand and silicon based grout. Accordingly, the tiles 212 and the grout 214 may deflect with the plate 20. The overlayment 210 may be any suitable flooring material, including, for example, carpeting, tiling, vinyl, etc. In this example, the tiles 212 width and length of each individual tile is less than the distance between each column 22.

Turning now to FIG. 8, an example of an enhanced flooring system 200 is shown. The system 200 includes one of the flooring apparatus 100 and/or 10 (the flooring apparatus 100 is illustrated) including an overlayment 210. In this example, the overlayment 210 comprises a plurality of tiles 212, such as traditional floor tiles, and a flexible grout 214, such as for example, a sand and silicon based grout. Accordingly, the tiles 212 and the grout 214 may deflect with the plate 20. The overlayment 210 may be any suitable flooring material, including, for example, carpeting, tiling, vinyl, etc. In this example, the tiles 212 width and length of each individual tile is less than the distance between each column 22.

Although certain example methods and apparatus have been described herein, the scope of coverage of this patent is not limited thereto. On the contrary, this patent covers all methods, apparatus and articles of manufacture fairly falling within the scope of the appended claims either literally or under the doctrine of equivalents.

I claim:

1. A floor comprising:

a flooring plate;

a plurality of spaced apart incompressible stiffening columns extending between an underside of the flooring plate and a support surface, the stiffening columns supporting the flooring plate a distance above the support surface, wherein when the floor is subjected to a compressive pressure between the flooring plate and the support surface less than a critical pressure, defined as the pressure at which the stiffening columns will buckle, the distance between the flooring plate and the support surface is substantially unchanged, and when the floor is subjected to a compressive pressure greater than the critical pressure, at least one of the stiffening columns will deform by buckling, thereby allowing deflection of the flooring plate towards the support surface, changing the distance between the flooring plate and the support surface; and a resilient underlayment at least partially surrounding at least a portion of the plurality of spaced apart stiffening columns and substantially filling a space between the plurality of stiffening columns, the resilient underlayment coupled to the stiffening columns in at least one location to influence the post-buckling deformation of the stiffening column, and to substantially prevent permanent deformation of the stiffening column.

2. A floor as defined in claim 1, wherein the flooring plate and the stiffening columns are integrally formed.

3. A floor as defined in claim 1, wherein the stiffening columns extend substantially perpendicular from the underside of the flooring plate.

4. A floor as defined in claim 1, wherein the stiffening columns have a generally rectangular cross-section.

5. A floor as defined in claim 1, wherein the length of each of the stiffening columns is substantially equal.

6. A floor as defined in claim 1, wherein the resilient underlayment is a foam.

7. A floor defined in claim 1, further comprising a plurality of spaced apart substantially incompressible deflection stop columns, extending from the underside of the flooring plate toward the support surface, wherein when the floor is subjected to a compressive pressure less than the critical pressure, the stop columns do not contact the support surface, and when the floor is subjected to a compressive pressure greater than the critical pressure the stop columns contact the support surface to substantially prevent the flooring plate from further movement toward the support surface.

8. A floor as defined in claim 1, further comprising a plurality of spaced apart substantially incompressible deflection stop columns having a length less than the stiffening columns and extending from the underside of the flooring plate toward the support surface, wherein when the stiffening columns deform, the deflection stop columns contact the support surface and remain substantially rigid so as to substantially prevent further deformation of the stiffening columns.

9. A floor as defined in claim 1, further comprising an overlayment covering at least a portion of a topside of the flooring plate.

10. A floor as defined in claim 9, wherein the overlayment comprises a plurality of tiles flexibly coupled together.

11. A floor as defined in claim 1, wherein the floor is a modular tile which is used in combination with other adjoining tiles to form a flooring system.

12. A floor as defined in claim 1, wherein the stiffening columns are at least partially coupled together to form at least one rib structure.

13. A floor as defined in claim 1, wherein the resilient underlayment covers at least a portion of the underside of the flooring plate.

14. A pressure reduction system for mounting on a support surface comprising:

an impact surface; an incompressible first resilient element extending between a first side of the impact surface and the support surface, the resilient element having a rigid state and a substantially deformable state, wherein the first resilient element supports the impact surface a distance above the support surface; and a second resilient element at least partially surrounding the first resilient element, wherein when a second side of the impact surface is subjected to a compressive pressure below a critical pressure defined as the pressure at which the first resilient element will buckle, the first resilient element remains in the incompressible, rigid state to prevent deflection of the impact surface towards the support surface, and wherein when the impact surface is subjected to a compressive pressure greater than the critical pressure, the stiffening columns deform by buckling to allow deflection of the impact surface toward the support surface, and wherein the second resilient element is coupled to at least a portion of the first resilient element to influence the post-buckling deformation of the first resilient element ~and to provide additional energy absorption during deflection of the impact surface and to substantially prevent permanent deformation of the first resilient element.

15. A pressure reduction system as defined in claim 14, further comprising a substantially non-compressible third resilient element coupled to and extending from the first side of the impact surface, having a length less than the first resilient element, being spaced away from the first resilient element, and being at least partially surrounded by the second resilient element, wherein the third resilient element remains substantially rigid when the first resilient element deforms by buckling to influence the deformation of the first resilient element and when the third resilient element contacts the support surface, the third resilient element substantially prevents the impact surface from further movement toward the support surface.

16. A pressure reduction system as defined in claim 14, wherein the second resilient element covers at least a portion of the first side of the impact surface.

17. A floor as defined in claim 1, wherein the flooring plate is a flexible membrane.

18. A floor as defined in claim 1, wherein the stiffening column is directly coupled to the underside of the flooring plate.

19. A floor as defined in claim 1, wherein the stiffening column directly contacts the support surface prior to the floor being subjected to a compressive pressure.

20. A floor as defined in claim 1, wherein the resilient underlayment increases the critical pressure necessary to deform the stiffening column by buckling.

21. A floor as defined in claim 1, wherein the resilient underlayment decreases the post-buckling deformation of the stiffening column.

22. A pressure reduction system as defined in claim 14, wherein the impact surface is a resilient surface.

23. A pressure reduction system as defined in claim 14, wherein the first resilient element is directly coupled to the impact surface.

24. A pressure reduction system as defined in claim 14, wherein the first resilient element directly contacts the support surface prior to the floor being subjected to a compressive pressure.

25. A pressure reduction system as defined in claim 14, wherein the second resilient element decreases the post-buckling deformation of the first resilient element.

26. An apparatus comprising:

an impact surface;

a plurality of spaced apart substantially incompressible stiffening columns extending between one side of the impact surface and a support surface, and supporting the impact surface a distance above the support surface, wherein when the apparatus is subjected to a compressive pressure between the impact surface and the support surface less than a critical pressure defined as the pressure at which the stiffening columns will buckle, the stiffening columns remain incompressible so as to prevent movement of the impact surface towards the support surface, and when the apparatus is subjected to a compressive pressure between the impact surface and the support surface greater than the critical pressure, at least one of the stiffening columns deform by buckling, thereby allowing deflection of the impact surface towards the support surface, changing the distance between the flooring plate and the support surface; and a resilient underlayment at least partially surrounding at least a portion of the plurality of spaced apart stiffening columns and substantially filling a space between the plurality of stiffening columns, the resilient underlayment coupled to the stiffening columns in at least one location to influence the post-buckling deformation of the stiffening column, and to substantially prevent permanent deformation of the stiffening column.

27. An apparatus as defined in claim 26, wherein the critical pressure is approximately 20 $lbs/in^2$.

28. An apparatus as defined in claim 26, wherein the cross section of at least one of the stiffening column includes an area moment of inertia different in a first direction than in a second direction.

* * * * *